US011428412B2

(12) United States Patent
Tentorio et al.

(10) Patent No.: US 11,428,412 B2
(45) Date of Patent: Aug. 30, 2022

(54) FUEL SPRAY NOZZLE HAVING AN AEROFOIL INTEGRAL WITH A FEED ARM

(71) Applicant: ROLLS-ROYCE plc, London (GB)

(72) Inventors: Luca Tentorio, Derby (GB); Juan Carlos Roman Casado, Derby (GB); Giacomo Di Chiaro, Derby (GB); Jonathan Knapton, Derby (GB); Filippo Zambon, Derby (GB); Radu Irimia, Derby (GB)

(73) Assignee: ROLLS-ROYCE plc, London (GB)

( * ) Notice: Subject to any disclaimer, the term of this patent is extended or adjusted under 35 U.S.C. 154(b) by 206 days.

(21) Appl. No.: 16/878,927

(22) Filed: May 20, 2020

(65) Prior Publication Data

US 2020/0378603 A1 Dec. 3, 2020

(30) Foreign Application Priority Data

Jun. 3, 2019 (GB) ..... 1907834

(51) Int. Cl.
*F23R 3/28* (2006.01)
*F23R 3/14* (2006.01)

(52) U.S. Cl.
CPC ..... *F23R 3/14* (2013.01); *F23R 3/28* (2013.01); *F23R 3/283* (2013.01); *F23R 3/286* (2013.01)

(58) Field of Classification Search
CPC ..... F23R 3/10; F23R 3/12; F23R 3/14; F23R 3/20; F23R 3/28; F23R 3/283; F23R 3/286; F23R 3/34; F23R 3/343; F23R 3/346; F23R 3/36
See application file for complete search history.

(56) References Cited

U.S. PATENT DOCUMENTS

| | | | | |
|---|---|---|---|---|
| 4,364,522 | A * | 12/1982 | Reider | F23R 3/14 239/399 |
| 5,511,375 | A * | 4/1996 | Joshi | F23R 3/36 60/737 |
| 5,778,676 | A * | 7/1998 | Joshi | F23D 17/002 60/737 |
| 6,141,967 | A * | 11/2000 | Angel | F23R 3/14 60/737 |
| 10,267,522 | B2 * | 4/2019 | Ciani | F02C 9/32 |
| 10,920,985 | B2 * | 2/2021 | Gao | F23R 3/12 |
| 2003/0084667 | A1 * | 5/2003 | Gerendas | F23R 3/14 60/740 |
| 2003/0110774 | A1 * | 6/2003 | Saitoh | F23R 3/14 60/737 |

(Continued)

FOREIGN PATENT DOCUMENTS

| | | |
|---|---|---|
| GB | 694448 | 7/1953 |
| GB | 723110 | 2/1955 |
| GB | 842197 | 7/1960 |

OTHER PUBLICATIONS

Response to Extended European Search Report from counterpart EP Application No. 20172695.7 dated Oct. 5, 2020, filed Jun. 8, 2021, 55 pgs.

(Continued)

*Primary Examiner* — William H Rodriguez
(74) *Attorney, Agent, or Firm* — Shumaker & Sieffert, P.A.

(57) ABSTRACT

A fuel spray nozzle arrangement for a combustor, the fuel spray nozzle arrangement comprising a fuel spray nozzle connected to a feed arm, wherein the feed arm comprises an aerofoil.

10 Claims, 7 Drawing Sheets

(56) References Cited

U.S. PATENT DOCUMENTS

| | | | | |
|---|---|---|---|---|
| 2004/0020210 | A1* | 2/2004 | Tanaka | F23R 3/14 60/740 |
| 2009/0277182 | A1* | 11/2009 | Engelbrecht | F23R 3/36 60/734 |
| 2011/0094232 | A1* | 4/2011 | Stewart | F23R 3/54 60/734 |
| 2012/0045725 | A1* | 2/2012 | Takiguchi | F23R 3/16 431/60 |
| 2012/0285172 | A1* | 11/2012 | Poyyapakkam | F23R 3/14 60/737 |
| 2013/0255263 | A1* | 10/2013 | Wilson | F23C 7/008 60/737 |
| 2015/0292743 | A1* | 10/2015 | Mook | F23R 3/286 29/889.22 |
| 2016/0003158 | A1* | 1/2016 | Ott | F23R 3/36 239/569 |
| 2016/0290649 | A1* | 10/2016 | Prociw | F23R 3/286 |
| 2017/0016620 | A1 | 1/2017 | Masquelet et al. | |

OTHER PUBLICATIONS

Great Britain search report dated Oct. 24, 2019, issued in GB Patent Application No. 1907834.4.

European Search report dated Sep. 23, 2020 issued in EP Patent Application No. 20172695.7.

* cited by examiner

FUEL SPRAY NOZZLE HAVING AN AEROFOIL INTEGRAL WITH A FEED ARM

CROSS-REFERENCE TO RELATED APPLICATIONS

This specification is based upon and claims the benefit of priority from UK Patent Application No. GB 1907834.4, filed on 3 Jun. 2019, which is hereby incorporated herein in its entirety.

BACKGROUND

Technical Field

The present disclosure relates to a fuel spray nozzle arrangement for a combustor in a gas turbine engine, and to a method of retrofitting a fuel spray nozzle arrangement.

Description of the Related Art

Fuel spray nozzles are a type of injector used in gas turbine engines to provide fuel to combustors for combustion. The fuel spray nozzle atomises fuel and ejects the atomised fuel into the combustor for more effective combustion.

However, in some previously-considered fuel spray nozzles the feed arm providing fuel to the fuel spray nozzle can obstruct air flow in certain regions of the gas turbine engine. A resultant non-uniformity in the air flow in the affected regions can have a detrimental impact on the amount of air supplied to the fuel spray nozzle, and on the atomisation of fuel.

SUMMARY

According to a first aspect of the disclosure, there is provided a fuel spray nozzle arrangement for a combustor, the fuel spray nozzle arrangement comprising a fuel spray nozzle connected to a feed arm, wherein the feed arm comprises an aerofoil.

Optionally, the aerofoil is an integral part of the feed arm.

Optionally, the feed arm comprises a feed arm body configured to support the fuel spray nozzle, wherein the fuel spray nozzle is configured so that when an elongate direction of the feed arm lies in a radial plane of the combustor, the aerofoil has a spanwise axis which extends substantially circumferentially or substantially tangentially with respect to a circumferential direction at a junction with the feed arm body.

Optionally, the aerofoil comprises a winglet extending from a feed arm body of the feed arm.

Optionally, the fuel spray nozzle comprises a swirler configured to swirl flow along an air channel, said air channel extending between an inlet and an outlet, wherein the winglet is configured to deflect an air flow around the feed arm radially inwards towards the inlet.

Optionally, the swirler is a main outer swirler of the fuel nozzle.

Optionally, the winglet is positioned radially-outwardly with respect to the inlet, and wherein the winglet has a chord line which is inclined radially-inwardly along an aft direction, relative to an axial direction of the combustor.

Optionally, the winglet extends from a leading edge to a trailing edge and a projected chord line running through the leading edge and trailing edge intersects the inlet.

Optionally, the arrangement comprises a further winglet extending from a surface of the feed arm body opposite the winglet.

According to a second aspect of the disclosure, there is provided a combustor comprising a fuel spray nozzle arrangement in accordance with the first aspect.

According to a third aspect of the disclosure, there is provided gas turbine engine comprising a combustor in accordance with the second aspect.

According to a fourth aspect of the disclosure, there is provided method of modifying a fuel spray nozzle arrangement for a combustor of a gas turbine engine, the fuel spray nozzle arrangement comprising a fuel spray nozzle connected to a feed arm, the method comprising the step of:

attaching a winglet to the feed arm.

The winglet may be positioned so as to provide a fuel spray nozzle having any of the features described above with respect to the first aspect.

Optionally, the fuel spray nozzle comprises a swirler configured to swirl flow along an air channel, said air channel extending between an inlet and an outlet, wherein the method further comprises the step of:

positioning the winglet to direct an airflow towards the inlet.

Optionally, the swirler is a main outer swirler of the fuel nozzle.

Optionally, the winglet extends from a leading edge to a trailing edge, and the method further comprises the step of:

positioning the leading edge and the trailing edge, such that a projected chord line running through the leading edge and trailing edge intersects the inlet.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds), for example in the range of from 0.28 to 0.32. These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform.

The radius of the fan may be measured between the engine centreline and the tip of a fan blade at its leading edge. The fan diameter (which may simply be twice the radius of the fan) may be greater than (or on the order of) any of: 220 cm, 230 cm, 240 cm, 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm, 390 cm (around 155 inches), 400 cm, 410 cm (around 160 inches) or 420 cm (around 165 inches). The fan diameter may be in an inclusive range bounded by any two of the values in the previous sentence (i.e. the values may form upper or lower bounds), for example in the range of from 240 cm to 280 cm or 330 cm to 380 cm.

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 220 cm to 300 cm (for example 240 cm to 280 cm or 250 cm to 270 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 330 cm to 380 cm may be in the range of from 1200 rpm to 2000 rpm, for example in the range of from 1300 rpm to 1800 rpm, for example in the range of from 1400 rpm to 1800 rpm.

In use of the gas turbine engine, the fan (with associated fan blades) rotates about a rotational axis. This rotation results in the tip of the fan blade moving with a velocity $U_{tip}$. The work done by the fan blades 13 on the flow results in an enthalpy rise dH of the flow. A fan tip loading may be defined as $dH/U_{tip}^2$, where dH is the enthalpy rise (for example the 1-D average enthalpy rise) across the fan and $U_{tip}$ is the (translational) velocity of the fan tip, for example at the leading edge of the tip (which may be defined as fan tip radius at leading edge multiplied by angular speed). The fan tip loading at cruise conditions may be greater than (or on the order of) any of: 0.28, 0.29, 0.30, 0.31, 0.32, 0.33, 0.34, 0.35, 0.36, 0.37, 0.38, 0.39 or 0.4 (all units in this paragraph being $Jkg^{-1}\ K^{-1}/(ms^{-1})^2$). The fan tip loading may be in an inclusive range bounded by any two of the values in the previous sentence (i.e. the values may form upper or lower bounds), for example in the range of from 0.28 to 0.31, or 0.29 to 0.3.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, 17, 17.5, 18, 18.5, 19, 19.5 or 20. The bypass ratio may be in an inclusive range bounded by any two of the values in the previous sentence (i.e. the values may form upper or lower bounds), for example in the range of form 12 to 16, 13 to 15, or 13 to 14. The bypass duct may be substantially annular. The bypass duct may be radially outside the core engine. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds), for example in the range of from 50 to 70.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}$ s, 105 $Nkg^{-1}$ s, 100 $Nkg^{-1}$ s, 95 $Nkg^{-1}$ s, 90 $Nkg^{-1}$ s, 85 $Nkg^{-1}$ s or 80 $Nkg^{-1}$ s. The specific thrust may be in an inclusive range bounded by any two of the values in the previous sentence (i.e. the values may form upper or lower bounds), for example in the range of from 80 $Nkg^{-1}$ s to 100 $Nkg^{-1}$ s, or 85 $Nkg^{-1}$ s to 95 $Nkg^{-1}$ s. Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). Purely by way of example, a gas turbine as described and/or claimed herein may be capable of producing a maximum thrust in the range of from 330 kN to 420 kN, for example 350 kN to 400 kN. The thrust referred to above may be the maximum net thrust at standard atmospheric conditions at sea level plus 15 degrees C. (ambient pressure 101.3 kPa, temperature 30 degrees C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400K, 1450K, 1500K, 1550K, 1600K or 1650K. The TET at cruise may be in an inclusive range bounded by any two of the values in the previous sentence (i.e. the values may form upper or lower bounds). The maximum TET in use of the engine may be, for example, at least (or on the order of) any of the following: 1700K, 1750K, 1800K, 1850K, 1900K, 1950K or 2000K. The maximum TET may be in an inclusive range bounded by any two of the values in the previous sentence (i.e. the values may form upper or lower bounds), for example in the range of from 1800K to 1950K. The maximum TET may occur, for example, at a high thrust condition, for example at a maximum take-off (MTO) condition.

A fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades maybe formed integrally with a central portion. Such an arrangement may be referred to as a bladed disc or a bladed ring. Any suitable method may be used to manufacture such a bladed disc or bladed ring. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 14, 16, 18, 20, 22, 24 or 26 fan blades.

As used herein, cruise conditions may mean cruise conditions of an aircraft to which the gas turbine engine is attached. Such cruise conditions may be conventionally defined as the conditions at mid-cruise, for example the conditions experienced by the aircraft and/or engine at the midpoint (in terms of time and/or distance) between top of climb and start of decent.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be the cruise condition. For some aircraft, the cruise conditions may be outside these ranges, for example below Mach 0.7 or above Mach 0.9.

Purely by way of example, the cruise conditions may correspond to standard atmospheric conditions at an altitude that is in the range of from 10000 m to 15000 m, for example in the range of from 10000 m to 12000 m, for example in the range of from 10400 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to: a forward Mach number of 0.8; a pressure of 23000 Pa; and a temperature of −55 degrees C. Purely by way of further example, the cruise conditions may correspond to: a forward Mach number of 0.85; a pressure of 24000 Pa; and a temperature of −54 degrees C. (which may be standard atmospheric conditions at 35000 ft).

As used anywhere herein, "cruise" or "cruise conditions" may mean the aerodynamic design point. Such an aerodynamic design point (or ADP) may correspond to the conditions (comprising, for example, one or more of the Mach Number, environmental conditions and thrust requirement) for which the fan is designed to operate. This may mean, for example, the conditions at which the fan (or gas turbine engine) is designed to have optimum efficiency.

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

DESCRIPTION OF THE DRAWINGS

Embodiments will now be described by way of example only, with reference to the Figures, in which.

DETAILED DESCRIPTION

Figure 1:
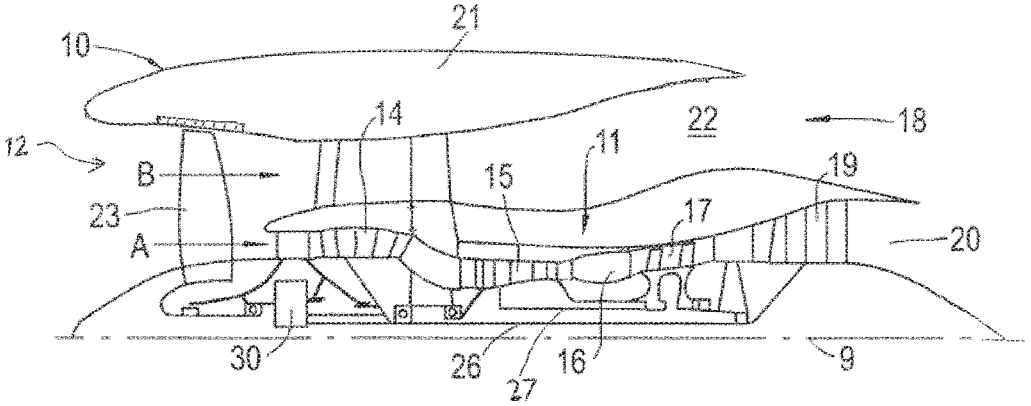
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low-pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
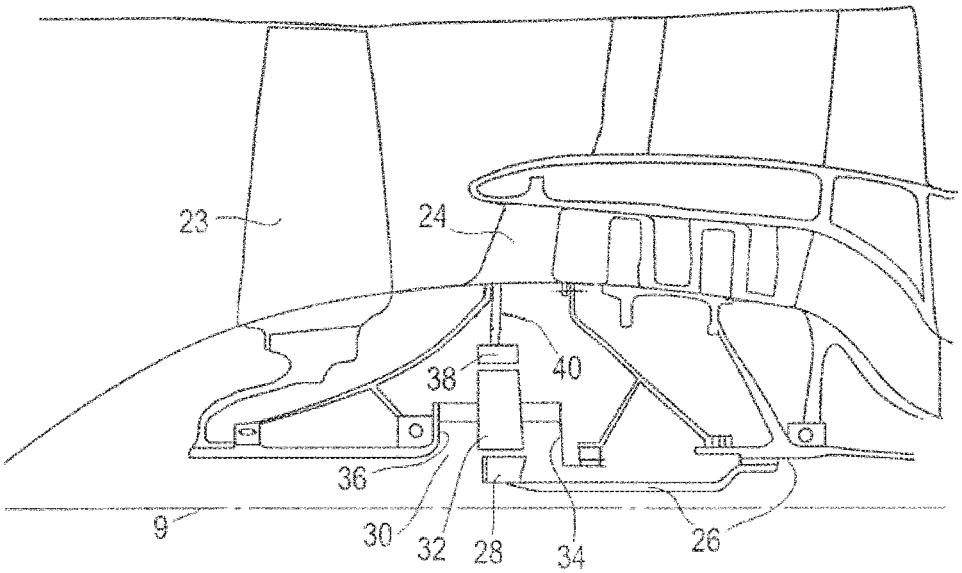
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
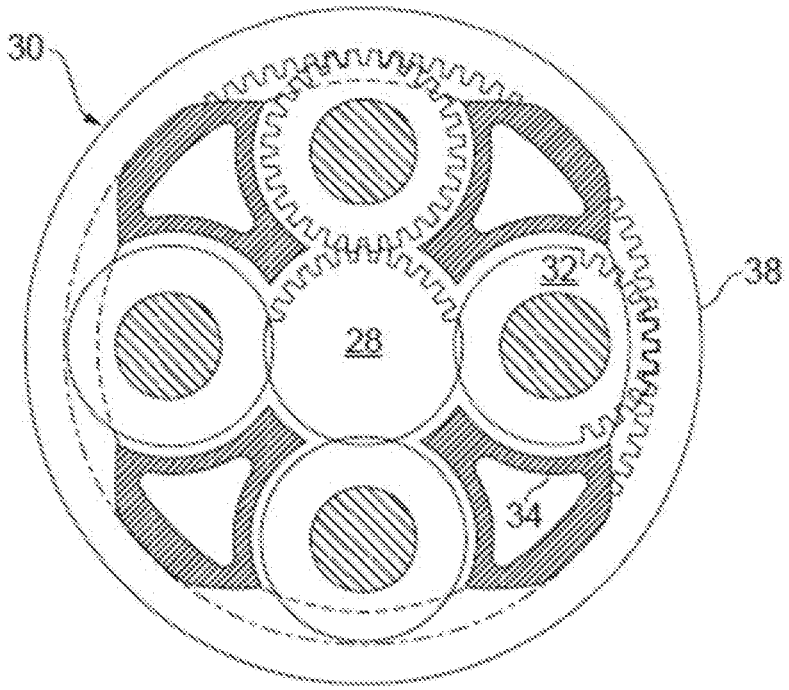
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the present disclosure. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 4:
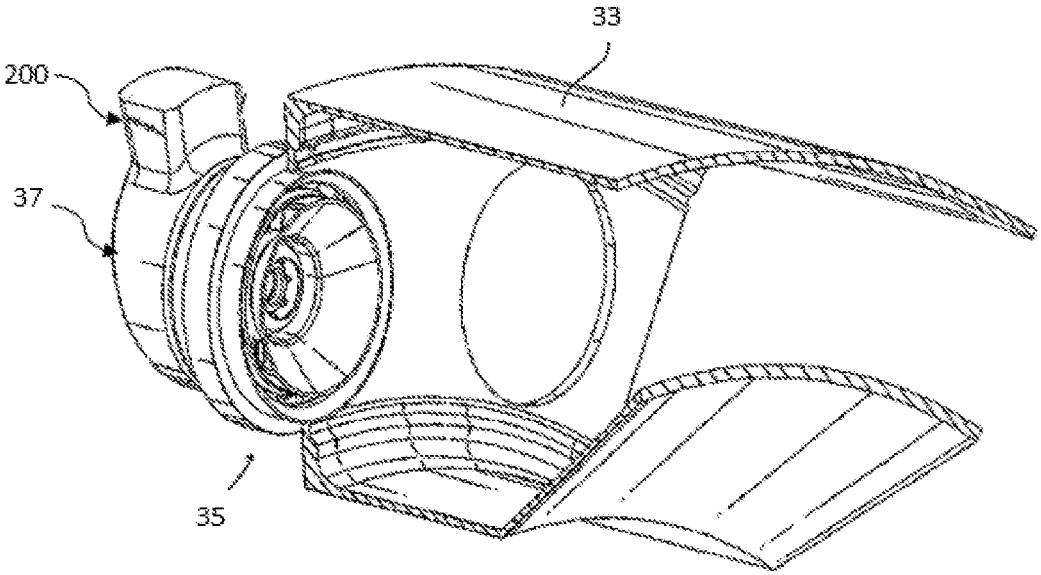
FIG. 4 schematically shows a cutaway view of a combustor with a fuel spray nozzle.

FIG. 4 shows a cutaway view of an annular combustor 33 of a gas turbine engine 10 defining a combustion chamber having an inlet 35 at an upstream end for receiving a fuel spray nozzle 37. The fuel spray nozzle 37 is configured to receive fuel from a feed arm 200, and to atomise the fuel so as to eject atomised fuel into the combustor 33 for combustion.

Figure 5:
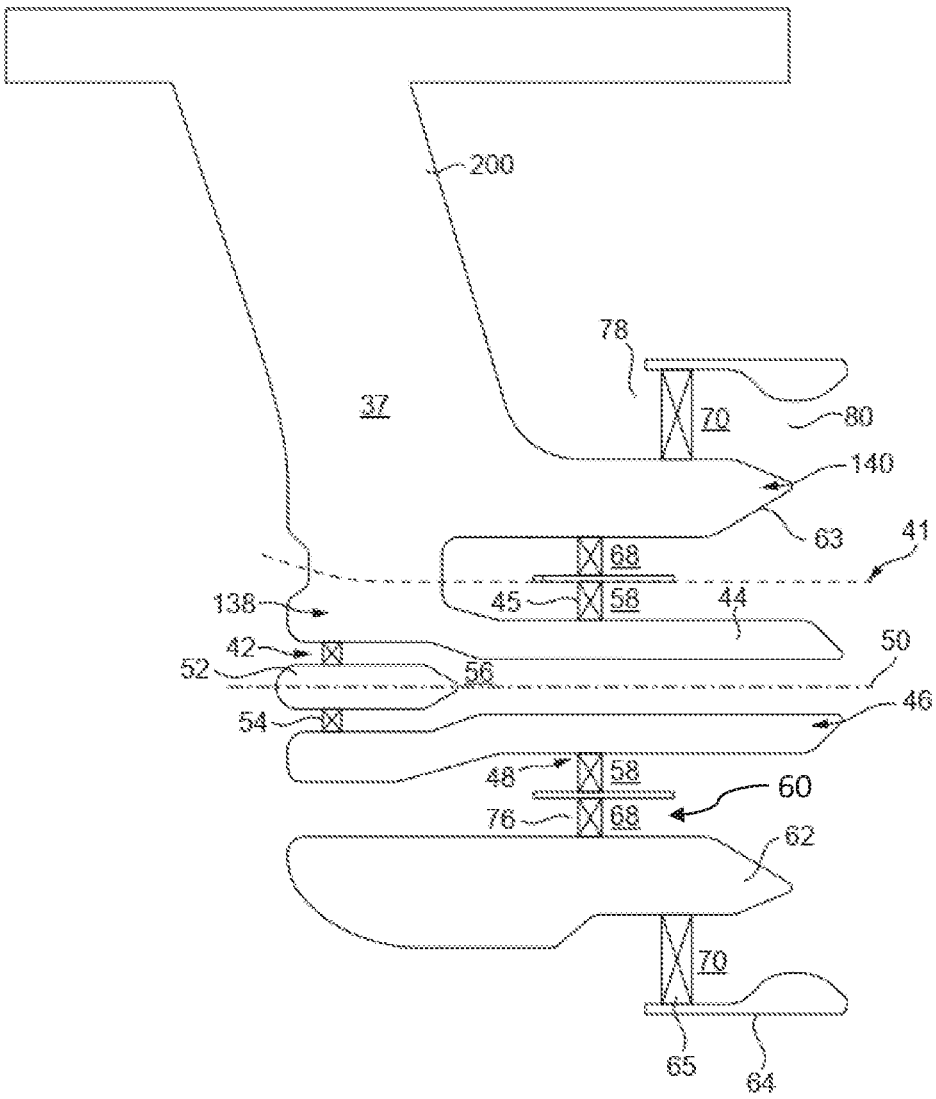
FIG. 5 shows a cross sectional view of a fuel spray nozzle.

FIG. 5 shows a cross-sectional side view of the fuel spray nozzle 37. The fuel spray nozzle has a generally circular profile from a front view. The fuel spray nozzle 37 comprises a primary atomiser 138 and a secondary atomiser 140. The primary atomiser 138 is a central or pilot swirler, and the secondary atomiser 140 is disposed radially outside of the primary swirler to surround it with respect to a central axis 50 of the fuel spray nozzle 37. The secondary atomiser 140 may be referred to as a peripheral atomiser in that it surrounds the primary atomiser 138. The primary atomiser 138 is configured to receive fuel, to receive an air flow at an upstream end, and to discharge a primary flow of atomised fuel into the combustion chamber. The secondary atomiser 140 is disposed circumferentially around the primary atomiser 138 and is configured to receive fuel, to receive an air flow at an upstream end, and to discharge a secondary flow of atomised fuel into the combustion chamber.

The primary and secondary atomisers may be provided as a common assembly, and may be wholly or partially integral with one another. The functional division between them will become clear from the following description. However, for clarity, a nominal dividing line 41 between the components of the primary and secondary atomisers 138, 140 is shown in FIG. 5. The dividing line 41 is shown only on one side of the fuel spray nozzle cross-section to show features of the fuel spray nozzle more clearly.

In use, only the primary atomiser 138 receives fuel in low flow conditions, and the secondary atomiser 140 receives fuel together with the primary atomiser 138 in high flow conditions.

The primary atomiser 138 comprises a primary inner air swirler 42, a primary fuel pre-filmer 44 and a primary outer air swirler 48. The primary inner air swirler 42 is disposed radially inwardly from the primary fuel pre-filmer 44 with respect to the central axis 50 of the fuel spray nozzle, and the primary outer air swirler 48 is disposed radially outwardly from the primary fuel pre-filmer 44.

A primary inner air channel 56 is defined radially within (i.e. inwardly of) the primary fuel pre-filmer 44 with respect to the central axis 50 of the fuel spray nozzle. The inner air swirler 42 is disposed within the primary inner air channel 56 and in this example comprises a central post 52 (otherwise known as a "bullet") having a plurality of vanes 54 distributed around the central post 52 and configured to impart a tangential velocity component to generate a swirling flow (e.g. helical). The central post 52 is aligned with a fuel spray nozzle axis 50 and the vanes 54 swirl air flowing through the primary inner air channel 56 (i.e. rotate or twist by imparting a circumferential/tangential component to the flow).

The primary fuel pre-filmer 44 defines an annular primary fuel pre-filmer channel 46. The primary fuel pre-filmer channel 46 is configured to receive pressurised fuel from a fuel source (not shown) and to eject an annular film of fuel from an outlet downstream of the primary inner air swirler 42.

The secondary atomiser 140 comprises a secondary inner air swirler 60, a secondary fuel pre-filmer 62 disposed radially outwardly from the secondary inner air swirler 60 with respect to the central axis 50 of the fuel spray nozzle, and a secondary outer air swirler 64 disposed radially outwardly of the secondary fuel pre-filmer 62. The secondary outer air swirler 64 is also known in the art as a main outer swirler, and the terms may be used interchangeably.

A primary outer air channel 58 is defined between the primary outer air swirler 48 and the secondary inner air swirler 60. The primary outer air swirler 48 comprises a plurality of vanes 45 distributed around a support provided by the primary fuel pre-filmer 44 which are configured to swirl air flowing through the primary outer air channel 58.

A secondary inner air channel 68 is defined between the secondary inner air swirler 60 and the secondary fuel pre-filmer 62. A secondary outer air channel 70 is defined between the secondary fuel pre-filmer 62 and the secondary outer air swirler 64. The secondary outer air channel 70 extends between an annular inlet 78 and an annular outlet 80.

The secondary fuel pre-filmer 62 defines an annular secondary fuel pre-filmer channel 63. The annular secondary fuel pre-filmer channel 63 is configured to receive pressurised fuel from a fuel source (not shown), supplied through the feed arm 200, and to eject an annular film of fuel from an outlet by the secondary inner air channel 68.

The secondary outer air swirler 64 comprises a peripheral support and a plurality of vanes 65 distributed around and radially inwardly from the peripheral support for swirling air flow through the secondary outer air channel 70. The secondary outer air swirler 64 is configured so that the secondary outer air channel 70 is generally conical and extends with a radially inward component (relative to the central axis 50 of the fuel spray nozzle) in a downstream direction along the fuel spray nozzle axis 50.

The secondary outer air channel 70 and the secondary inner air channel 68 are configured so that their respective air flows collide. Between the secondary inner channel 68 and the secondary outer channel 70, the secondary fuel pre-filmer 62 ejects the film of fuel which collides with these air flows. These colliding swirled flows atomise the fuel in the fuel film, so that the secondary atomiser 140 ejects a secondary flow of atomised fuel into the combustion chamber.

The feed arm 200 supplies fuel from a fuel source (not shown) to the secondary fuel pre-filmer 62.

Figure 6B:
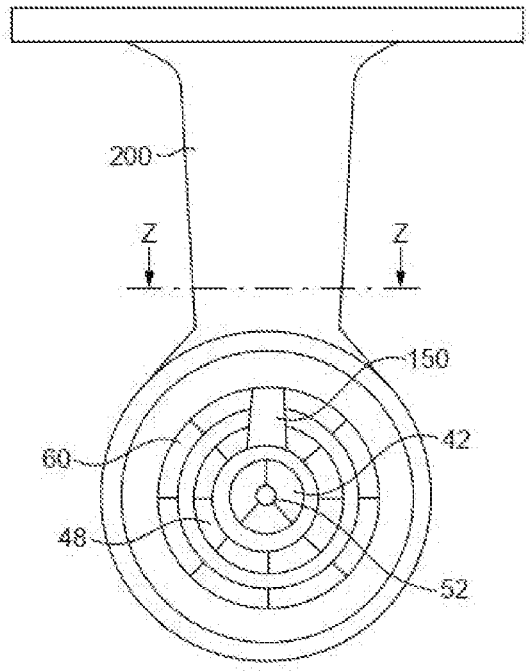
FIG. 6B shows a cross-sectional view along the line Z-Z shown in FIG. 6A.
Figure 6A:
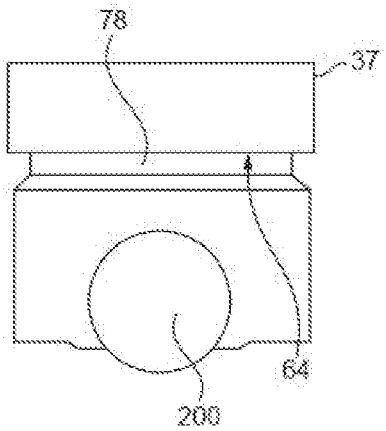
FIG. 6A shows a rear view of the fuel spray nozzle of FIG. 5.

FIG. 6A shows a rear view of the fuel spray nozzle of FIG. 5. As described above with respect to FIG. 5, air enters the primary inner air channel 56, the primary outer air channel 58, and the secondary inner air channel 68 by flowing into inlets of the primary inner air swirler 42, primary outer air swirler 48, and secondary inner air swirler 60 respectively, which are generally spaced apart from the feed arm 200 since the feed arm 200 connects to the fuel spray nozzle 37 from a radially-outer side with respect to a central axis of the combustor or engine.

A pilot feed arm 150 extends between the secondary atomiser 140 and the primary atomiser 138. The pilot feed arm 150 receives fuel from the feed arm 200 and supplies the fuel to the primary fuel pre-filmer 44.

FIG. 6B shows a cross-sectional view corresponding to the line Z-Z shown in FIG. 6A. In this view, it can be seen that the inlet of the secondary outer air swirler 64 is aft of the feed arm 200 (i.e. is downstream of the feed arm 200 along the fuel spray nozzle axis 5). Air enters the secondary outer air channel 70 by flowing into the annular inlet 78 of the secondary outer air channel 70.

The presence of the feed arm 200 can lead to disrupted air flow in a portion of the annular inlet 78 proximate the feed arm 200, relative to air flow at other circumferential portions of the annular inlet 78. Air flow flowing into this portion of the inlet 78 and air entering, transiting and/or exiting the secondary outer air channel 70 may be disrupted, leading to a poorer atomisation of fuel from the secondary atomiser 140. Such disruption may take the form of transient flow patterns, such as may result from vortex shedding behind the feed arm 200, or other irregular flow patterns. This may, in turn, lead to a non-uniform burning of fuel in the combustor.

The feed arm 200 is generally cylindrical in shape, and so has a generally circular cross-sectional shape. This may lead to an irregular flow field in the region immediately downstream of the feed arm 200, as will be described in more detail below.

Figure 7A:
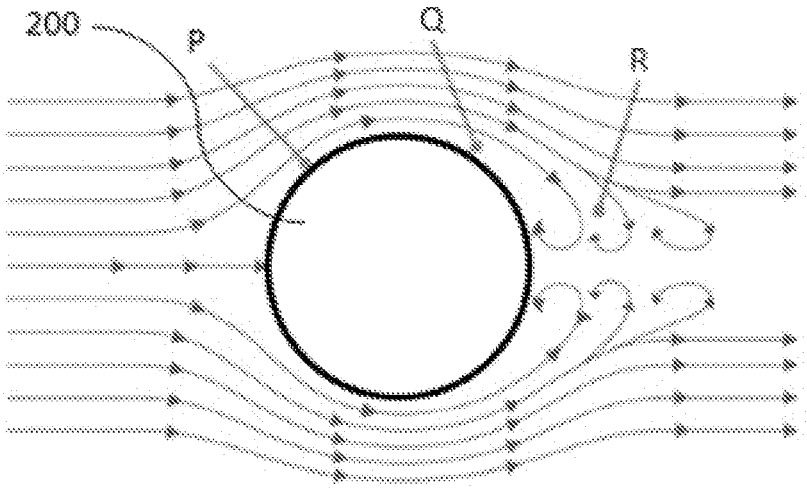
FIG. 7A (PRIOR ART)
FIG. 7A schematically shows air flow around a prior art fuel nozzle feed arm.

FIG. 7A schematically shows air flow around the previously-considered fuel nozzle feed arm 200 shown in FIGS. 5, 6A and 6B. The left of the Figure represents a region upstream of the fuel nozzle feed arm 200 and the right of the Figure represents a region downstream of the fuel nozzle feed arm 200, with air flowing as indicated by the arrows.

The region indicated by P represents an area where the air flow attaches to the feed arm 200. The region indicated by Q represents an area where the air flow separates from the feed arm 200. The region indicated by R represents a region of turbulent wake downstream of the feed arm 200, in which a region of low pressure occurs.

If a low pressure region occurs near to the rear inlet 78 of the secondary outer air channel 70 it can lead to an insufficient amount of air entering the secondary outer air channel 70 to allow the fuel spray nozzle 37 to operate effectively. A cylindrical feed arm may also exhibit a von Kármán vortex street downstream of the feed arm (a repeating pattern of swirling vortices), which disrupts the air flow downstream of the feed arm.

Figure 7B:
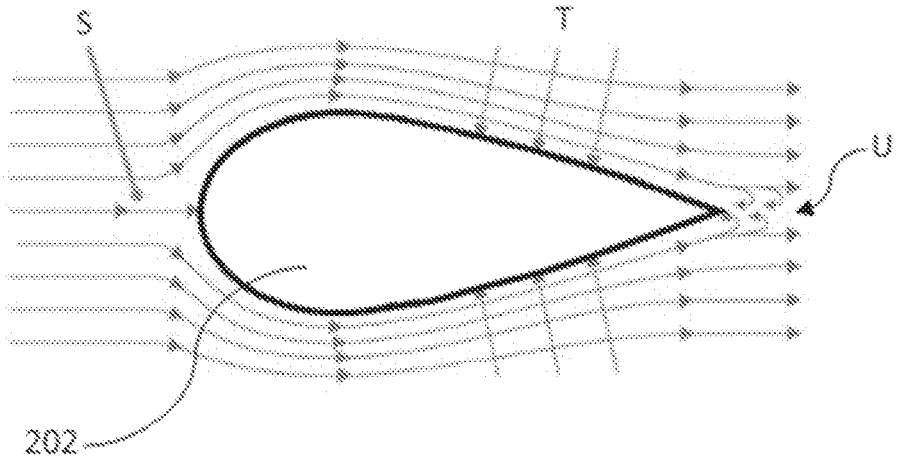
FIG. 7B schematically shows air flow around a fuel nozzle feed arm suitable for use in embodiments of the present disclosure.

FIG. 7B schematically shows air flow around a fuel nozzle feed arm 202 suitable for use in a fuel nozzle arrangement in accordance with an embodiment of the present disclosure, for example in place of the fuel nozzle feed arm 200 described above with respect to FIG. 5. The left of the Figure represents a region upstream of the fuel nozzle feed arm 202 and the right of the Figure represents a region downstream of the fuel nozzle feed arm 202, with air flowing as indicated by the arrows. The fuel nozzle feed arm 202 has a generally teardrop cross-sectional shape, comprising a bluff C-shaped (e.g. semi-cylindrical) section at an upstream portion and a tapered section at a downstream portion. For example, the cross-sectional shape of the fuel nozzle feed arm may be a symmetrical aerofoil of having a leading edge radius equal to half the maximum thickness.

The region indicated by S represents a region of high pressure, where the airflow acts on the feed arm 202 in a downstream direction. The region indicated by T represents an area where the airflow attaches to the feed arm 202. A region of turbulent wake may occur in the region indicated at U downstream of the trailing edge of the aerofoil, however this may represent a reduced area of low pressure compared to the region R shown in FIG. 7A, as the air flow remains attached to the feed arm up to a trailing edge of the feed arm. Vortex shedding is also reduced with this shape of feed arm, and so no von Kármán vortex street arises downstream of the feed arm 202.

In some examples, the pilot feed arm 150 could be provided with a similar cross-sectional shape to the feed arm 202 in order to improve air flow to the primary outer air channel 58 and the secondary inner air channel 68 in the region immediately downstream of the pilot feed arm 150.

While the exemplary feed arm 202 shown in FIG. 7B comprises a symmetrical aerofoil, any aerofoil shape could be used in practice, provided said shape reduces the region of turbulent wake downstream of the feed arm 202 compared to conventional feed arms having generally circular cross-sectional shapes. However, substantially symmetrical aerofoil shapes are preferred as these avoid the imparting of imbalanced forces on the feed arm 202 by the passing air flow.

Figure 8:
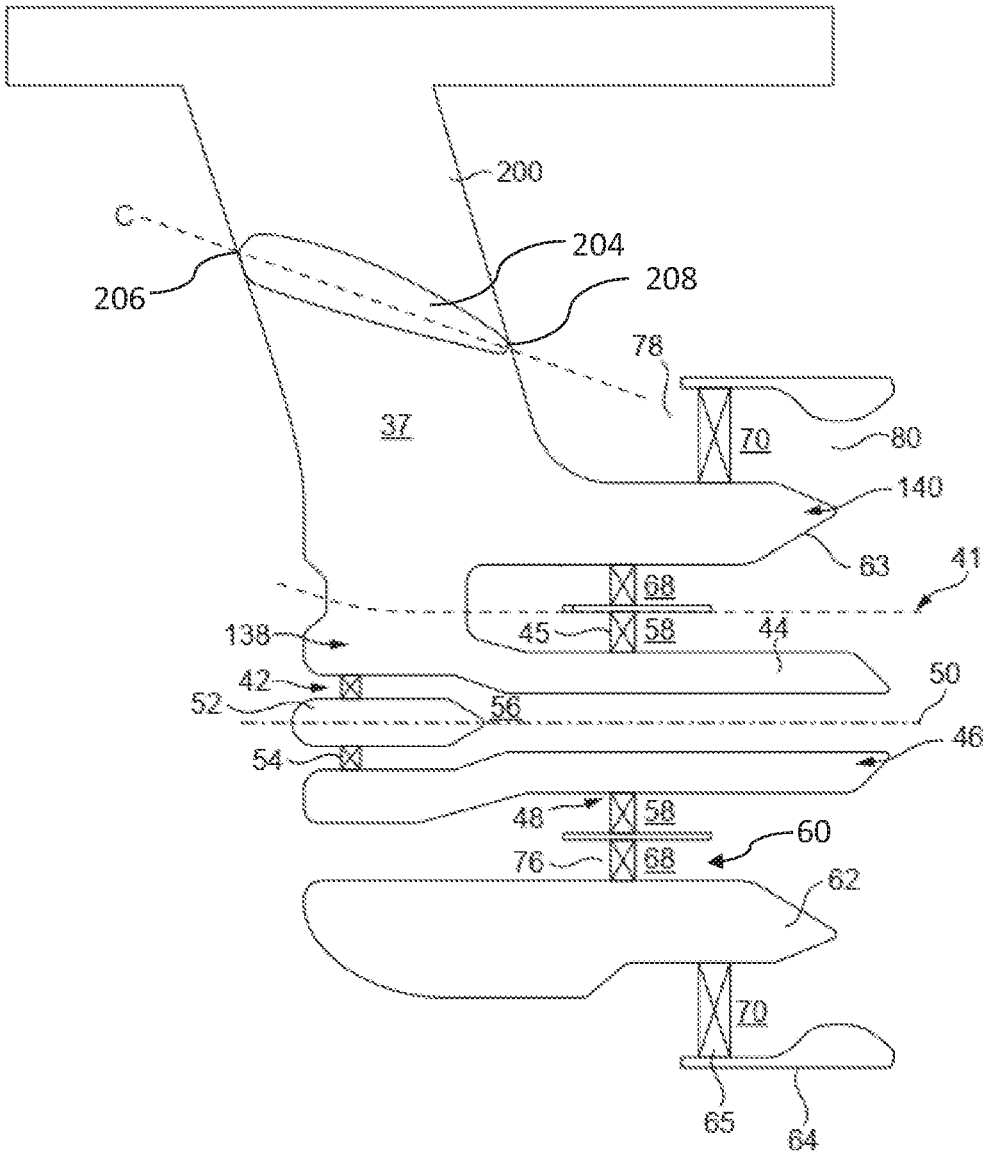
FIG. 8 shows a fuel spray nozzle arrangement in accordance with an embodiment of the present disclosure.

FIG. 8 shows a fuel nozzle feed arm in accordance with an embodiment of the present disclosure.

The feed arm 200 and fuel nozzle 37 are identical to those described above with reference to FIGS. 4-7A, and like reference numerals are retained to illustrate common parts.

An elongate direction of the feed arm lies generally in a radial plane of the combustor, i.e. a longitudinal axis of the feed arm 200 extends approximately perpendicularly to the central axis 50 of the fuel spray nozzle. An aerodynamic winglet 204 extends in a spanwise direction (i.e. of the winglet) from a lateral side of the feed arm 200. The winglet 204 has a spanwise axis which extends substantially circumferentially, or substantially tangentially with respect to a circumferential direction, around the central axis 50 of the fuel spray nozzle at a junction where the winglet 204 meets the feed arm 200.

The winglet 204 extends in a chordwise direction from a leading (i.e. upstream) edge 206 to a trailing (i.e. downstream) edge 208. A chord line C running through the leading edge 206 and the trailing edge 208 of the winglet, projected past the trailing edge 208, extends radially inwardly with respect to an central axis of the combustor (and the engine), and in this example towards the inlet 78 of the secondary outer air channel 70 as shown (in particular, intersecting the inlet 78). The winglet 204 therefore acts to direct air flow into the secondary outer air channel 70.

It will be understood that the present disclosure is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

For example, while only one aerodynamic winglet is shown in the example of FIG. 8, in other examples any number of winglets may be used to improve air flow to the fuel nozzle. In some examples, a second winglet may be symmetrically placed on the opposite lateral side of the feed arm. In other examples, a series of winglets may be spaced along the feed arm in a direction towards/away from the nozzle axis. In other examples, a series of winglets may be spaced along the feed arm in an upstream/downstream direction.

Further, the winglet may be a separate aerofoil attached to a conventional feed arm (as in the example of FIG. 8). In other examples one or more aerofoil could be integrally formed with the feed arm. In other examples, one or more aerofoils could be combined with (e.g. integrally form with, or attached to) a streamlined feed arm, such as the one shown in FIG. 7B.

In some examples, the aerofoil could be formed by one or more grooves or channels in a side of the feed arm. In some examples, the aerofoil could be formed by one or more apertures or passages through the feed arm.

While the example described above is suitable for a combustor in a gas turbine engine of an aircraft, the present disclosure is not restricted to aerospace applications, and could be applied to any engine incorporating a combustor (e.g. a stationary gas turbine engine).

The invention claimed is:

1. A fuel spray nozzle arrangement for a combustor, the fuel spray nozzle arrangement comprising a fuel spray nozzle connected to a feed arm, wherein the fuel spray nozzle comprises a swirler configured to swirl flow along an air channel, said air channel extending between an inlet and an outlet, and wherein the feed arm comprises an aerofoil, the aerofoil comprising a winglet extending from a feed arm body of the feed arm, and wherein the winglet is configured to deflect an air flow around the feed arm radially inward toward the inlet of the air channel.

2. The fuel spray nozzle arrangement according to claim 1, wherein the aerofoil is an integral part of the feed arm.

3. The fuel spray nozzle arrangement according to claim 1, wherein the feed arm comprises a feed arm body configured to support the fuel spray nozzle, wherein the fuel spray nozzle is configured so that when an elongate direction of the feed arm lies in a radial plane of the combustor, the aerofoil has a spanwise axis which extends substantially circumferentially or substantially tangentially with respect to a circumferential direction at a junction with the feed arm body.

4. The fuel spray nozzle arrangement according to claim 1, wherein the swirler is a main outer swirler of the fuel nozzle.

5. The fuel spray nozzle arrangement according to claim 1, wherein the winglet is positioned radially-outwardly with respect to the inlet, and wherein the winglet has a chord line which is inclined radially-inwardly along an aft direction, relative to an axial direction of the combustor.

6. The fuel spray nozzle arrangement according to claim 1, wherein the winglet extends from a leading edge to a trailing edge and a projected chord line (C) running through the leading edge and trailing edge intersects the inlet.

7. A combustor comprising a fuel spray nozzle arrangement in accordance with claim 1.

8. A gas turbine engine comprising a combustor in accordance with claim 7.

9. A method of modifying a fuel spray nozzle arrangement for a combustor of a gas turbine engine, the fuel spray nozzle arrangement comprising a fuel spray nozzle connected to a feed arm, wherein the fuel spray nozzle comprises a swirler configured to swirl flow along an air channel, said air channel extending between an inlet and an outlet, the method comprising the step of:

attaching a winglet to the feed arm, wherein the winglet extends from a leading edge to a trailing edge;

positioning the winglet to direct an airflow towards the inlet of the air channel; and positioning the leading edge and the trailing edge of the winglet, such that a projected chord (C) line running through the leading edge and trailing edge of the winglet intersects the inlet of the air channel.

10. The method according to claim 9, wherein the swirler is a main outer swirler of the fuel nozzle.

* * * * *